US008176598B2

(12) United States Patent
Casavant et al.

(10) Patent No.: US 8,176,598 B2
(45) Date of Patent: May 15, 2012

(54) LOCKING SPACER ASSEMBLY FOR A CIRCUMFERENTIAL DOVETAIL ROTOR BLADE ATTACHMENT SYSTEM

(75) Inventors: Matthew Stephen Casavant, Greenville, SC (US); Bradley Taylor Boyer, Greenville, SC (US)

(73) Assignee: General Electric Company, Schenectady, NY (US)

( * ) Notice: Subject to any disclaimer, the term of this patent is extended or adjusted under 35 U.S.C. 154(b) by 446 days.

(21) Appl. No.: 12/534,529

(22) Filed: Aug. 3, 2009

(65) Prior Publication Data

US 2011/0027090 A1 Feb. 3, 2011

(51) Int. Cl.
*F01D 5/32* (2006.01)

(52) U.S. Cl. ..... 16/215

(58) Field of Classification Search ..... 416/215, 416/216, 218, 220 R
See application file for complete search history.

(56) References Cited

U.S. PATENT DOCUMENTS 2,857,134 A * 10/1958 Arkless ..... 416/216
4,208,170 A * 6/1980 Tucker et al. ..... 416/221
4,859,149 A 8/1989 McClain
4,915,587 A 4/1990 Pisz et al.
5,431,543 A 7/1995 Brown et al.
5,817,372 A 10/1998 Zheng
6,033,185 A 3/2000 Lammas et al.
6,368,672 B1 4/2002 Thompson et al.
6,929,453 B2 * 8/2005 Kite et al. ..... 416/220 R
7,309,214 B2 * 12/2007 Bachofner et al. ..... 416/215
7,435,055 B2 10/2008 Hansen et al.
2006/0222502 A1 10/2006 Hansen et al.
2010/0290914 A1 * 11/2010 Souers et al. ..... 416/221

* cited by examiner

*Primary Examiner* — Edward Look
*Assistant Examiner* — Liam McDowell
(74) *Attorney, Agent, or Firm* — Dority & Manning, P.A.

(57) ABSTRACT

A dual-component locking spacer assembly for insertion in a circumferential dovetail slot includes a stationary member having a platform configured to fit into a space between the adjacent rotor blade platforms. A first leg extends transversely from an underside of the platform. A longitudinally extending groove is defined in the platform. A slide member is movably engaged with the stationary member along the groove, and includes an upper plate and a second leg connected to the upper plate. The slide member is movable along the groove between a first unlocked position wherein the first and second legs are spaced apart a first distance so as to be insertable into the dovetail slot, and a second locked position wherein the first and second legs are spaced apart an extended second distance so as to engage against opposite walls of the dovetail slot and lock the stationary member in position in the dovetail slot.

16 Claims, 5 Drawing Sheets

LOCKING SPACER ASSEMBLY FOR A CIRCUMFERENTIAL DOVETAIL ROTOR BLADE ATTACHMENT SYSTEM

FIELD OF THE INVENTION

The present invention relates generally to circumferential entry rotor dovetail systems, and more particularly to a locking spacer assembly for use in such a system.

BACKGROUND OF THE INVENTION

A conventional gas turbine includes a rotor with various rotor blades mounted to rotor disks in the fan, compressor, and turbine sections thereof. Each blade includes an airfoil over which the pressurized air flows, and a platform at the root of the airfoil that defines the radially inner boundary for the airflow. The blades are typically removable, and therefore include a suitable dovetail configured to engage a complementary dovetail slot in the perimeter of the rotor disk. The dovetails may either be axial-entry dovetails or circumferential-entry dovetails that engage corresponding axial or circumferential slots formed in the disk perimeter. A typical dovetail includes a neck of minimum cross sectional area extending radially inwardly from the bottom of the blade platform. The neck diverges outwardly into a pair of opposite dovetail lobes.

For circumferential dovetails, a single dovetail slot is formed between forward and aft continuous circumferential posts or "hoops" and extends circumferentially around the entire perimeter of the disk. An example of this type of configuration is shown in U.S. Pat. No. 6,033,185. The circumferential slot may be locally enlarged at one location for allowing the individual dovetails to be initially inserted therein and then repositioned circumferentially along the dovetail slot until the entire slot is filled with a full row of the blades. The cross-sectional shape of the circumferential dovetail slot includes lobe recesses defined by forward and aft rotor disk hoops that cooperate with the dovetail lobes to radially retain the individual blades against centrifugal force during turbine operation.

A plurality of blades, specifically the dovetail component, are slid into and around the circumferential slot to define a complete stage of rotor blades around the circumference of the rotor disks. The blades include platforms at the root end that may be in abutting engagement around the slot. In other embodiments, spacers may be installed in the circumferential slot between adjacent rotor blade platforms. Once all of the blades (and spacers) have been installed, a final remaining space in the slot is typically filled with a specifically designed spacer assembly, as generally known in the art.

Various conventional spacer assemblies are relatively complicated multi-component devices that rely on a bolt, cam, or other torque mechanism that is turned to actuate oppositely disposed move members into engagement with the disk hoops. The cam piece, bolt, or other functional member is then locked down. Other devices radially bolt the two pressure faces together. These conventional systems are generally difficult to assemble, and are prone to coming apart during operation of the turbine, for example if either side of the devices develop clearance relative to adjacent turbine components (i.e., the rotor disks or blade platforms). Another problem often encountered in conventional designs is that the components are difficult to fit together.

BRIEF DESCRIPTION OF THE INVENTION

Aspects and advantages of the invention will be set forth in part in the following description, or may be obvious from the description, or may be learned through practice of the invention.

In one aspect, the present invention provides a unique locking spacer assembly for use in a rotor circumferential dovetail slot between platforms of adjacent rotor blades to fill a final space in the slot. The assembly may include a stationary member having a platform configured to fit into the space between the adjacent rotor blade platforms. For example, the platform may have a width, length, and thickness so as to fill the space and lie flush with the rotor blade platforms. The stationary member further includes a first leg extending transversely from an underside of the platform and having a configuration so as to extend into the dovetail slot. A longitudinally extending groove is defined in the platform. A slide member is movably engaged with the stationary member so as to slide along the groove. The slide member includes an upper plate and a second leg connected to the upper plate, for example so as to extend transversely from an underside of the upper plate. The second leg also has a configuration so as to extend into the dovetail slot opposite from the first leg. The slide member is movable along the groove between a first unlocked position wherein the first and second legs are spaced apart a first distance so as to be insertable from above into the dovetail slot at the space between the adjacent rotor blade platforms. The slide member is movable to a second locked position wherein the first and second legs are spaced apart an extended (as compared to the first distance) second distance such that the first and second legs engage against opposite walls of the dovetail slot. In the locked position of the slide member, the stationary member is non-removably locked into the dovetail slot.

In another aspect, the present invention also encompasses a rotor assembly having a rotor with a rotor disk. Forward and aft hoop components of the disk define a continuous circumferentially extending dovetail slot. A plurality of rotor blades are installed around the dovetail slot, with each rotor blade having a platform and a dovetail extending from the platform into the dovetail slot. A locking spacer assembly is installed between at least two of the rotor blades. The locking spacer assembly may be configured as discussed above and described in greater detail herein.

These and other embodiments and features of the invention will be described in greater detail in the following description.

BRIEF DESCRIPTION OF THE DRAWINGS

The invention, in accordance with preferred and exemplary embodiments, together with further aspects and advantages thereof, is more particularly described in the following detailed description taken in conjunction with the accompanying drawings in which.

DETAILED DESCRIPTION OF THE INVENTION

Figure 1:
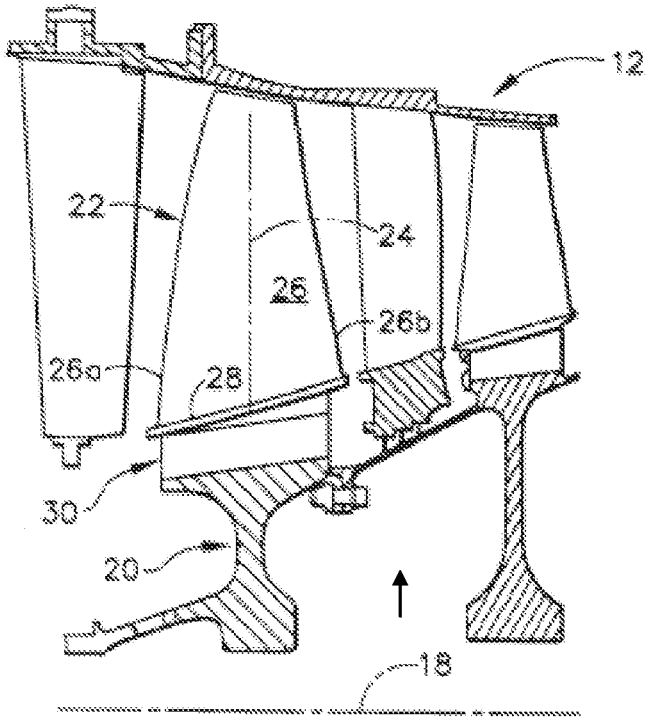
Fig. 1 Prior Art
FIG. 1 is a partial sectional view of components of a conventional gas turbine configuration.

Reference is now made to particular embodiments of the invention, one or more examples of which are illustrated in the drawings. Each embodiment is presented by way of explanation of aspects of the invention, and should not be taken as a limitation of the invention. For example, features illustrated or described with respect to one embodiment may be used with another embodiment to yield still a further embodiment. It is intended that the present invention include these and other modifications or variations made to the embodiments described herein.

Components of a conventional gas turbine are illustrated, for example, in FIG. 1 wherein a rotor 12 includes a plurality of rotor disks 20 disposed coaxially with the centerline axis 18 of the turbine. A plurality of circumferentially spaced rotor blades 22 are removably fixed to the disk and extend radially outward therefrom. Each blade 22 has a longitudinal centerline axis 24 and includes an airfoil section 26 having a leading edge 26*a* and a trailing edge 26*b* (in the direction of airflow over the blade 22). Each blade 22 has a platform 28 that provides a portion of the radially inner boundary for the airflow over the airfoils 26, and an integral dovetail 30 that extends radially inward from the platform 28. The dovetails 30 slide into and along a circumferentially extending dovetail slot defined by forward and aft hoop components of the rotor disk 20, as is generally known in the art.

Figure 2:
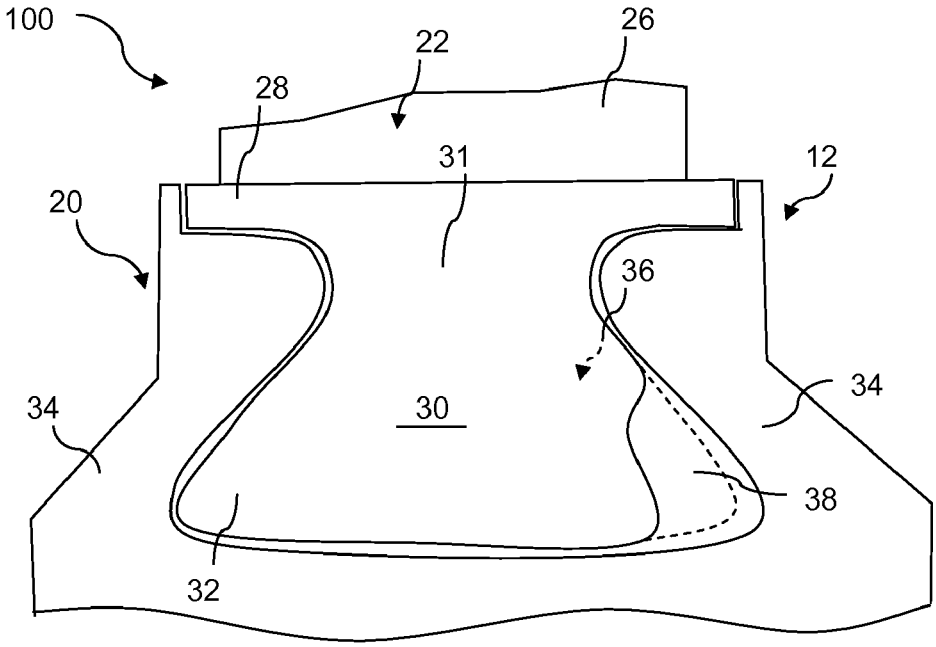
Fig. 2 Prior Art
FIG. 2 is a partial sectional view of an exemplary rotor dovetail and dovetail slot configuration for circumferential entry rotor blades.

FIG. 2 is a more detailed view of an exemplary dovetail and dovetail slot configuration. The rotor blade 22 includes a platform 28 with an integrally formed dovetail 30 extending therefrom into the dovetail slot 36 defined by facing walls of forward and aft hoops 34 of the rotor disk 20. The dovetail 30 includes lobes 32 that are received into lobe recesses 38 in the dovetail slot 30 defined by arcuate portions of the hoop walls. It should be readily appreciated that the configuration of the dovetail 30 and dovetail slot 36 in FIG. 2 is for illustrative purposes only, and that the dovetail and slot configuration may vary widely within the scope and spirit of the invention.

Figure 3:
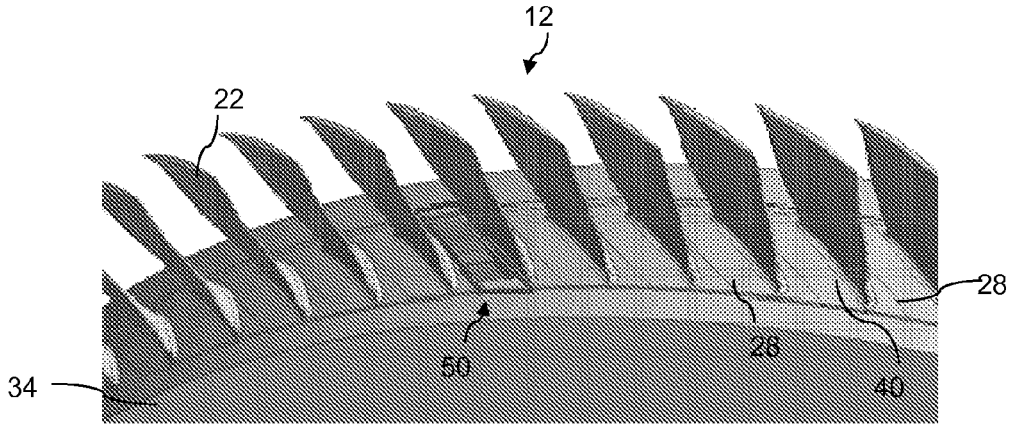
FIG. 3 is a partial perspective view of a rotor disk with a locking spacer assembly according to aspects of the invention between platforms of adjacent rotor blades.

FIG. 3 is a partial perspective view of a portion of a rotor 12, and particularly illustrates a plurality of rotor blades configured in a dovetail slot between forward and aft hoop components 34 of the rotor disk 20. Each of the rotor blades 22 includes a platform 28. Conventional spacers 40 may be disposed between the platforms 28 of adjacent blades, as is generally known in the art. A locking spacer assembly 50 in accordance with aspects of the present invention is illustrated in FIG. 3 in partial cut-away and serves the function of a final spacer assembly after all of the circumferential-entry rotor blades 22 (and associated spacers 40 if used) have been inserted into the dovetail slot. The locking spacer assembly 50 is described in greater detail below.

Figure 4:
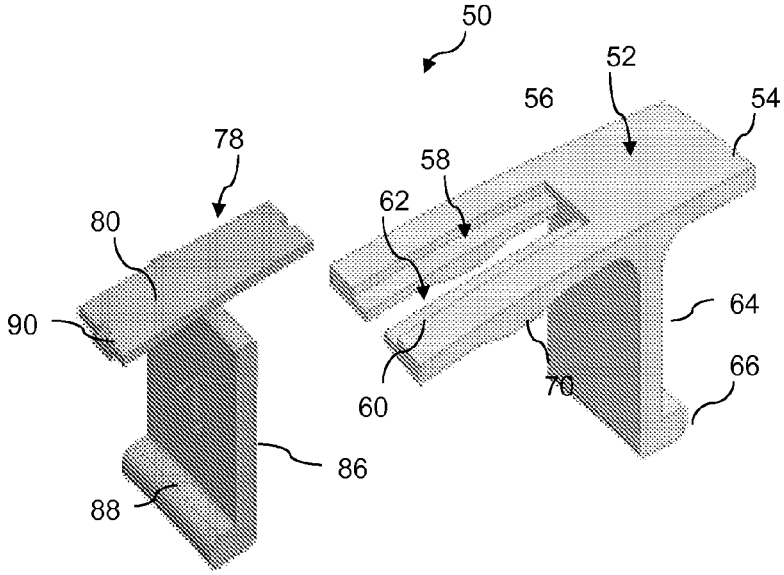
FIG. 4 is a perspective view of components of an embodiment of a locking spacer assembly in accordance with aspects of the invention.

FIG. 4 illustrates the dual components of an embodiment of the locking spacer assembly 50. The assembly 50 includes a stationary member 52 having a platform 54 configured to fit into the space between adjacent rotor blade platforms 28, as illustrated in FIG. 3. The platform 54 may, thus, have any dimensional configuration such that the width, length, thickness, or any other characteristic enables the platform 54 to be inserted between the rotor blade platforms 28, and preferably to lie essentially flush with the top surfaces of the rotor blade platforms 28 and conventional spacers 40.

Figure 6:
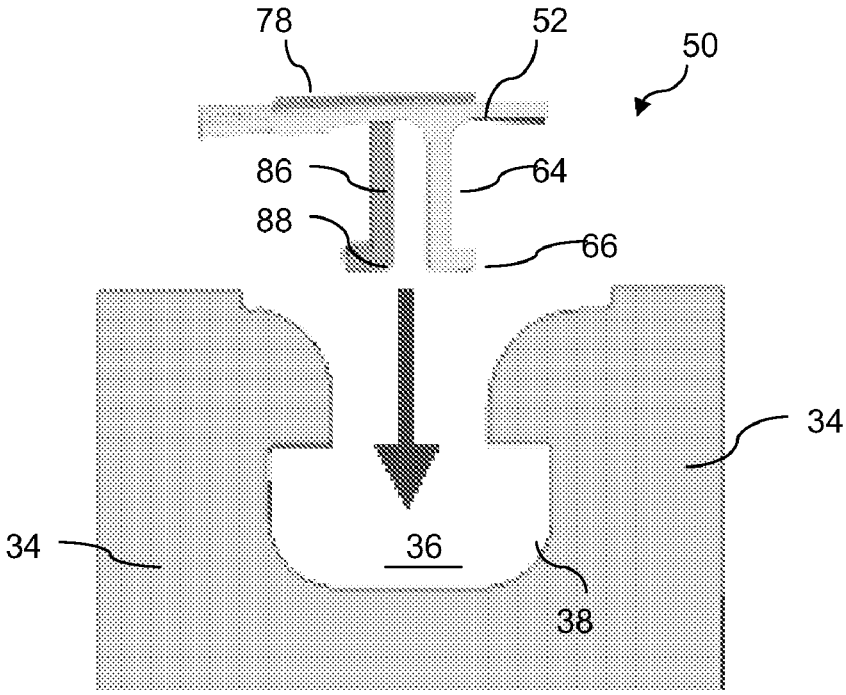
FIG. 6 is a perspective view of the components of FIG. 4 being inserted into a dovetail slot.

The stationary member 54 includes a first leg 64 that may be formed integral with the platform 54, or may comprise a component that is separately attached to the platform 54. The first leg 64 extends generally transversely from the underside of the platform 54 and has a shape and configuration so as to extend into a dovetail slot 36, as generally illustrated in FIG. 6. It should be readily appreciated that the first leg 64 may have any desired configuration, and need not be a straight component as illustrated in the figures. The shape and configuration of the first leg 64 will depend in large part on the particular shape and profile of the dovetail slot 36. The first leg 64 also may include a foot member 66 configured so as to extend into the lobe recess 38 in the dovetail slot 36 and engage against the wall of the hoop component 34.

The stationary member 50 may include a groove 62 defined in the platform 54, as generally illustrated in FIG. 4. This groove 62 is longitudinally extending along the platform 54 so as to be oriented between the hoop components 34 when the locking spacer assembly 50 is inserted into a rotor.

The locking spacer assembly 50 includes a slide member 78 that is movably engaged with the stationary member 52. In the illustrated embodiment, the slide member 78 engages with the stationary member 52 along the groove 62 and is movable relative to the stationary member 52 between an unlocked position and a locked position, as described in greater detail below.

The slide member 78 includes an upper plate 80 and a second leg 86 connected to the upper plate, for example, to an underside of the upper plate 80. The second leg 86 may be formed as an integral component with the upper plate 80, or may constitute a separate component that is attached to the upper plate 80. As with the first leg 64, the second leg 86 may have any manner of shape or configuration, and is intended to be inserted into the dovetail slot 36 (FIG. 6) and to engage against the opposite hoop component 34. The second leg 86 may include a foot 88 that fits into the lobe recess 38 and engages against the wall of the hoop component 34.

Figure 9:
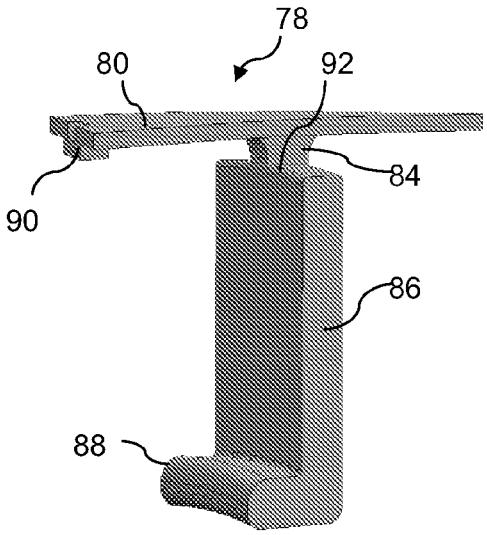
FIG. 9 is a perspective view of an embodiment of a slide member component of the locking spacer assembly.
Figure 10:
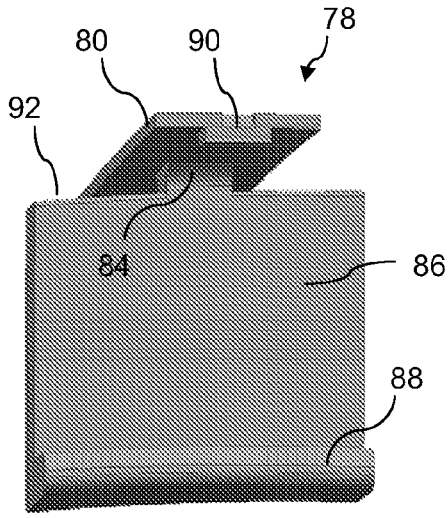
FIG. 10 is an alternate perspective view of the slide member of FIG. 9.

As particularly illustrated in FIGS. 9 and 10, an intermediate neck 84 may connect the second leg 86 to the upper plate 80. This neck 84 has a shape and configuration so as to slide within the groove 62 defined in the platform 54 of the stationary member 52.

Figure 8:
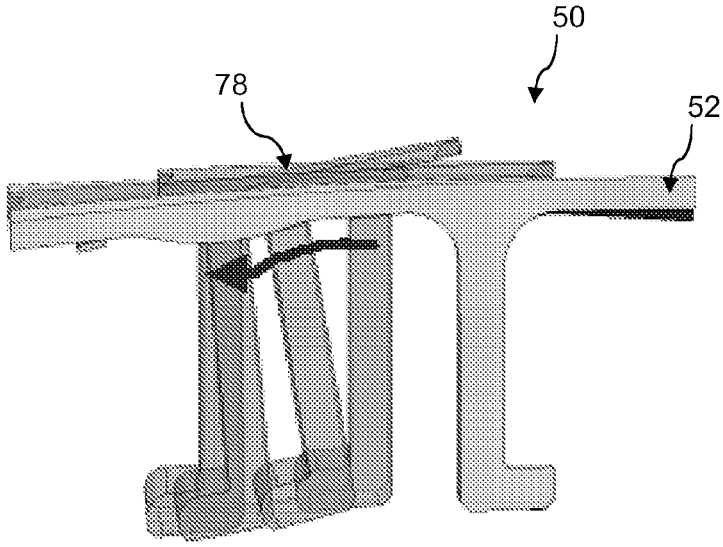
FIG. 8 is a sequential operational view of the locking spacer of FIG. 4, with the slide member being moved from an unlocked position to a locked position.

The slide member 78 is movable along the groove 62 between a first unlocked position (illustrated in FIGS. 5 and 6) wherein the first and second legs 64, 86 are spaced apart a distance so that the legs are insertable into the dovetail slot 36 from above, as illustrated in FIG. 6. Once the legs have been inserted into the dovetail slot 36 and the platform 54 of the stationary member 52 is seated on the hoop components 34, the slide member 78 is repositioned to a locked position wherein the first and second legs 64, 86 are spaced apart an extended distance (as compared to the distance in the unlocked position) such that the first and second legs engage against opposite walls of the hoop components 34 that define the dovetail slot 36. Movement of the slide member 78 relative to the stationary member 52 is depicted in FIG. 8. In the locked position of the slide member 78, the first and second legs 64, 86 are engaged in the dovetail slot 36, and the stationary member is non-removably locked into the dovetail slot.

Figure 5:
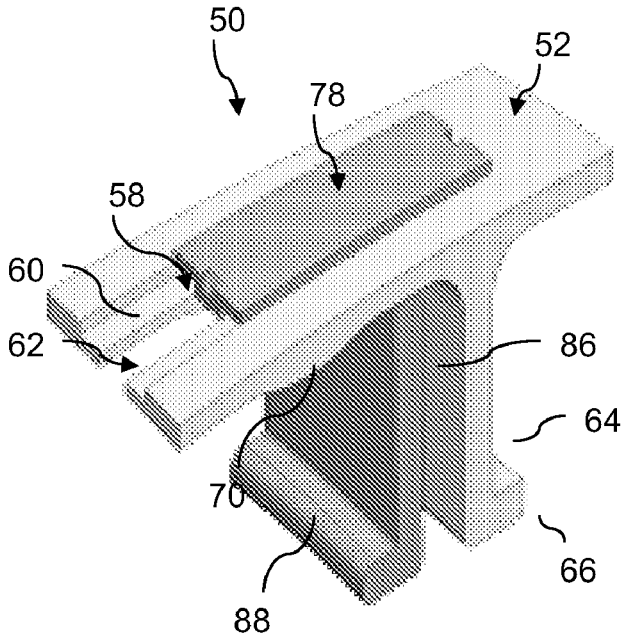
FIG. 5 is a perspective view of the components of FIG. 4 in an assembled state.

Referring particularly to FIGS. 4 and 5, in a unique embodiment of the locking spacer assembly 50, an elongated recess 58 is defined in the upper surface 56 of the platform 54, The groove 62 is formed in the recess, with the recess 58 including shoulders 60 on opposite sides of the groove 62. The recess 58 is configured so that in the locked position of the slide member 78, the upper plate 80 of the slide member fits into the recess so as to be generally flush with the upper surface 56 of the platform 54, as illustrated in the final position of the slide member 78 in FIG. 8. In the unlocked position of the slide member 78, the upper plate 80 is disposed above the upper surface 56 of the platform 54 and, essentially, slides along the upper surface until the upper plate 80 drops into the recess 58.

Figure 7A:
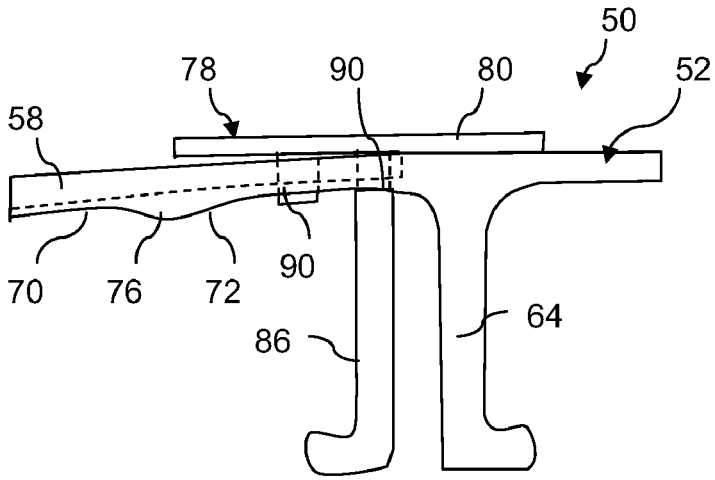
FIGS. 7A, 7B, and 7C are sequential operations views of an embodiment of a locking spacer assembly in accordance with the invention, with the slide member being moved from an unlocked position to a locked position.
Figure 7B:
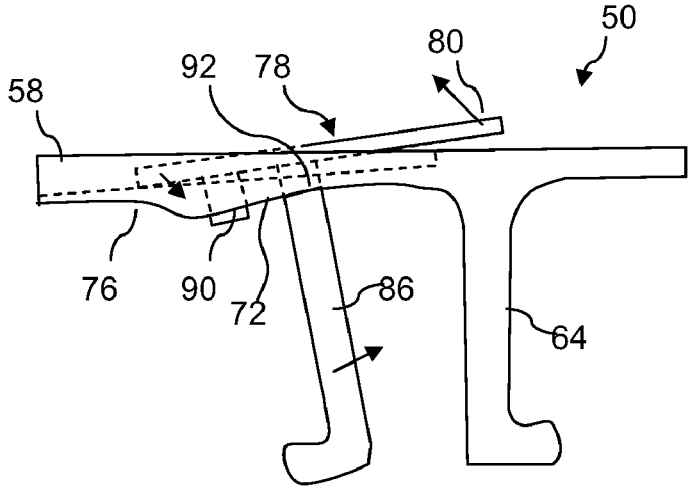
Figure 7C:
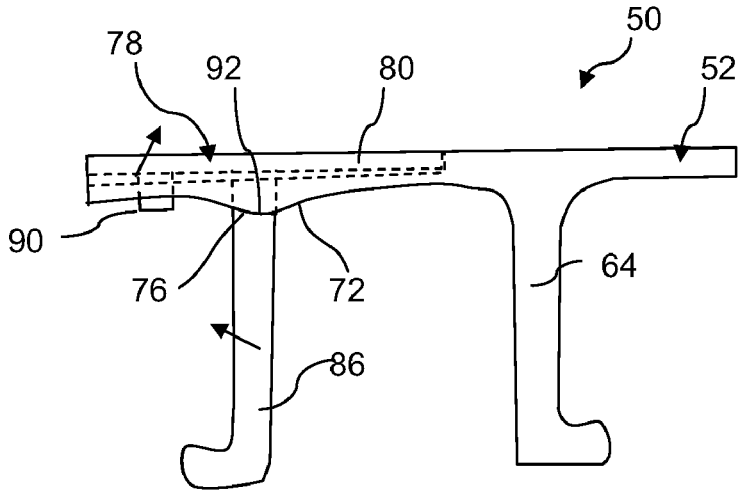

Referring to FIGS. 5 and 7A through 7C in particular, a cam surface 70 is defined along the groove 62, for example on an underside of the platform 54. A cam follower 92 is configured on the slide member 78 and engages the cam surface 70 upon movement of the slide member 78 between the locked and unlocked positions. The cam follower 92 may comprise any structure of the slide member 78 that slides along the cam surface 70. In the illustrated embodiment, the cam follower 92 is defined by transversely extending shoulders of the second leg 86. These shoulders are defined, for example, on opposite sides of the neck 84, as particularly illustrated in FIG. 10. Thus, as illustrated in the sequential operational views of FIGS. 7A through 7C, the neck 84 extends through the groove 62 and the cam follower surfaces 92 are engaged against the cam surface 70. The cam surface 70 has a unique profile defined by a first section 72 in the initial travel path of the slide member 78, and a second section 76 defined at the locked position of the slide member 78. The first profile section 72 causes the upper plate 80 of the slide member 78 to tilt into the recess 58 while the second leg 86 is pivoted towards the first leg 64 upon initial movement of the slide member 78 from the unlocked position towards the locked position, as depicted in FIGS. 7A and 7B. Further movement of the slide member 78 towards the locked position causes the cam follower surfaces 92 to engage the second profile section 76 of the cam surface 70. The second section has a unique curvature that causes the upper plate 80 to tilt in an opposite direction into the recess 58 while the second leg 86 pivots away from the first leg, as depicted in FIG. 7C. The recess 58 is defined at a downward angle relative to the upper surface of the platform (in a direction away from the first leg 64) so as to accommodate tilting of the upper plate 80, as depicted in FIG. 7B.

In the locked position of the slide member 78 as depicted in FIG. 7C, engagement of the cam follower surfaces 92 against the second profile section 76 imparts a locking bias on the slide member 78 such that the leg 86 is urged away from the first leg 64 and into engagement with the dovetail slot wall, and the forward or leading edge of the upper plate 80 is urged in the direction of the arrow indicated in FIG. 7C such that the trailing edge of the upper plate 80 is biased into contact with the shoulders 60 of the recess 58.

In the illustrated embodiment, a guide tab 90 is also provided on the underside of the upper plate 80 of the stationary member 78. The guide tab 90 has dimensions so as to slide along the groove 62, as particularly illustrated in FIGS. 7A through 7C.

The unique configuration of the slide member 78 relative to the stationary member 52, and in particular the interaction of the cam follower surfaces 92 with the cam surface 70, results in a unique snap-action locking of the upper plate 80 of the slide member 78 into the recess 58 of the platform 54. This action gives a positive indication that the locking spacer assembly 50 has been properly seated in the dovetail slot and has been securely locked into position.

It should be appreciated that the present invention also encompasses a rotor assembly 100 (FIG. 2) incorporating a locking spacer assembly 50 as described and embodied herein. The rotor assembly 100 includes a rotor 12 having a rotor disk 20 with forward and aft hoops 34 defining a continuous circumferentially extending dovetail slot 36. A plurality of rotor blades 22 are fitted into the dovetail slot, with each of rotor blade 22 including a platform 28 and a dovetail 30 extending from the platform into the dovetail slot 36. A locking spacer assembly 50 in accordance with any of the embodiments illustrated or described herein is disposed in a space between two of the rotor blade platforms 28, as described above.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A locking spacer assembly for insertion in a circumferential dovetail slot between platforms of adjacent rotor blades, comprising:

a stationary member having a platform configured to fit into a space between the adjacent rotor blade platforms, said stationary member further comprising a first leg extending transversely from an underside of said platform and having a configuration so as to extend into the dovetail slot;

a longitudinally extending groove defined in said platform;

a slide member movably engaged with said stationary member along said groove, said slide member comprising an upper plate and a second leg connected to said upper plate, said second leg having a configuration so as to extend into said dovetail slot opposite from said first leg;

said slide member movable along said groove between a first unlocked position wherein said first and second legs are spaced apart a first distance so as to be insertable into the dovetail slot, and a second locked position wherein said first and second legs are spaced apart an extended second distance such that said first and second legs engage against opposite walls of the dovetail slot and said stationary member is locked in said dovetail slot.

2. The locking spacer assembly as in claim 1, further comprising an elongated recess defined in an upper surface of said platform, said groove defined in said recess, said upper plate of said slide member fitted into said recess in said locked position of said slide member so as to be generally flush with said upper surface of said platform.

3. The locking spacer assembly as in claim 2, wherein said slide member further comprises a neck disposed between said upper plate and said second leg, said neck extending through said groove.

4. The locking spacer assembly as in claim 3, wherein said upper plate is disposed above said upper surface of said platform in said first unlocked position of said slide member.

5. The locking spacer assembly as in claim 2, further comprising a cam surface defined along said groove on said underside of said platform, and a cam follower configured on said slide member, said cam surface comprising a first profile section that causes said upper plate to tilt into said recess while said second leg pivots towards said first leg as said slide member initially moves from said first unlocked position towards an intermediate position along said groove.

6. The locking spacer assembly as in claim 5, wherein said recess is defined at a downward angle relative to said upper surface of said platform so as to accommodate tilting of said upper plate.

7. The locking spacer assembly as in claim 6, wherein said cam surface comprises a second profile section that causes said upper plate to tilt in an opposite direction into said recess while said second leg pivots away from said first leg as said slide member moves from said intermediate position to said second locked position.

8. The locking spacer assembly as in claim 6, wherein engagement of said cam follower with said second profile section of said cam surface maintains a locking bias on said slide member in said second locked position of said slide member.

9. A rotor assembly, comprising:

a rotor having a rotor disk with forward and aft hoops defining a continuous circumferentially extending dovetail slot;

a plurality of rotor blades, each of said rotor blades comprising a platform and a dovetail extending from said platform into said dovetail slot;

a locking spacer assembly disposed between at least two of said rotor blades, said locking spacer assembly further comprising:

a stationary member having a platform configured to fit into a space between the adjacent rotor blade platforms, said stationary member further comprising a first leg extending transversely from an underside of said platform and extending into said dovetail slot;

a longitudinally extending groove defined in said platform;

a slide member movably engaged with said stationary member along said groove, said slide member comprising an upper plate and a second leg connected to said upper plate, said second leg extending into said dovetail slot opposite from said first leg;

said slide member movable along said groove between a first unlocked position wherein said first and second legs are spaced apart a first distance so as to be insertable into said dovetail slot, and a second locked position wherein said first and second legs are spaced apart an extended second distance such that said first and second legs engage against opposite walls of said dovetail slot and said stationary member is locked in said dovetail slot.

10. The rotor assembly as in claim 9, wherein said locking spacer assembly further comprises an elongated recess defined in an upper surface of said platform, said groove defined in said recess, said upper plate of said slide member fitted into said recess in said locked position of said slide member so as to be generally flush with said upper surface of said platform.

11. The rotor assembly as in claim 10, wherein said slide member further comprises a neck disposed between said upper plate and said second leg, said neck extending through said groove.

12. The rotor assembly as in claim 11, wherein said upper plate is disposed above said upper surface of said platform in said first unlocked position of said slide member.

13. The rotor assembly as in claim 10, wherein said locking spacer assembly further comprises a cam surface defined along said groove on said underside of said platform, and a cam follower configured on said slide member, said cam surface comprising a first profile section that causes said upper plate to tilt into said recess while said second leg pivots towards said first leg as said slide member initially moves from said first unlocked position towards an intermediate position along said groove.

14. The rotor assembly as in claim 13, wherein said recess is defined at a downward angle relative to said upper surface of said platform so as to accommodate tilting of said upper plate.

15. The rotor assembly as in claim 13, wherein said cam surface comprises a second profile section that causes said upper plate to tilt in an opposite direction into said recess while said second leg pivots away from said first leg as said slide member moves from said intermediate position to said second locked position.

16. The rotor assembly as in claim 13, wherein engagement of said cam follower with said second profile section of said cam surface maintains a locking bias on said slide member in said second locked position of said slide member.

* * * * *